US006369365B1

(12) United States Patent
Nass et al.

(10) Patent No.: US 6,369,365 B1
(45) Date of Patent: Apr. 9, 2002

(54) GLASS-CERAMIC PANEL PROVIDING A COOKING SURFACE WITH A COOKING ZONE INDICATING DEVICE AND METHOD OF MAKING SAME

(75) Inventors: Peter Nass, Mainz; Dietmar Wennemann, Albig; Dietmar Schoenig, Mainz; Stefan Hubert, Bubenheim; Patrik Schober, Mainz, all of (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 09/493,788

(22) Filed: Jan. 28, 2000

(30) Foreign Application Priority Data

Feb. 18, 1999 (DE) ..... 199 06 737

(51) Int. Cl.[7] ..... H05B 3/68
(52) U.S. Cl. ..... 219/445.1; 219/506
(58) Field of Search ..... 219/445.1, 255, 219/282, 298, 320, 350, 376, 382, 506; 99/374, 389; 338/295; 392/407, 408, 559; 40/560

(56) References Cited

U.S. PATENT DOCUMENTS

| | | | | | |
|---|---|---|---|---|---|
| 3,763,347 | A | * | 10/1973 | Whitaker | 64/4.3 |
| 4,136,224 | A | * | 1/1979 | Minami et al. | |
| 4,345,000 | A | * | 8/1982 | Kawazoe et al. | |
| 4,373,283 | A | * | 2/1983 | Swartz | 40/564 |
| 4,584,501 | A | * | 4/1986 | Cocks et al. | 313/493 |
| 4,763,133 | A | * | 8/1988 | Takemura et al. | 343/912 |
| 5,103,077 | A | * | 4/1992 | Goessler et al. | 219/453 |
| 5,585,160 | A | * | 12/1996 | Osthassel | 428/66.5 |
| 5,750,959 | A | | 5/1998 | Plumptre | |
| 5,763,068 | A | * | 6/1998 | Kishino et al. | 428/323 |
| 5,809,680 | A | * | 9/1998 | Scheidler et al. | 40/580 |
| 5,911,899 | A | * | 6/1999 | Yoshikai et al. | 219/522 |
| 5,981,115 | A | * | 11/1999 | Furuya et al. | 430/19 |
| 6,057,529 | A | * | 5/2000 | Kirby | 219/445.1 |
| 6,069,346 | A | * | 5/2000 | Hyllberg | 219/469 |
| 6,087,944 | A | * | 7/2000 | Santacatterina et al. | 340/588 |
| 6,104,007 | A | * | 8/2000 | Lerner | 219/453 |
| 6,205,691 | B1 | * | 3/2001 | Urda et al. | 40/559 |

FOREIGN PATENT DOCUMENTS

| | | |
|---|---|---|
| DE | 40 02 322 A1 | 8/1991 |
| DE | 40 04 309 A1 | 8/1991 |
| DE | 44 05 610 A1 | 8/1995 |
| DE | GB 297 12 137.5 | 9/1997 |
| DE | 197 00 551 A1 | 7/1998 |
| EP | 0 540 876 A2 | 5/1993 |

* cited by examiner

*Primary Examiner*—Teresa Walberg
*Assistant Examiner*—Daniel Robinson
(74) *Attorney, Agent, or Firm*—Michael J. Striker

(57) ABSTRACT

Modern cooking ranges have a glass-ceramic panel (1) providing a cooking surface with at least one cooking zone, which typically is associated with a radiating heated body. To indicate the cooking zone and, if necessary, the residual heat, it is known to associate an externally lighted annular glass with the heated body, which is observable from above as a lighted ring. A structured lighted cooking zone indicating device is provided according to the present invention by a structured light-impermeable coating layer (2) applied directly to the underside of the glass-ceramic panel (1) having transparent regions forming a predetermined or desired structure or pattern within the cooking zone indicating device. This cooking zone indicating device is made by a screen printing technique in which a heat-resistant light-impermeable varnish is applied to the underside of the glass-ceramic panel to form the structured coating layer (2).

11 Claims, 1 Drawing Sheet

GLASS-CERAMIC PANEL PROVIDING A COOKING SURFACE WITH A COOKING ZONE INDICATING DEVICE AND METHOD OF MAKING SAME

BACKGROUND OF THE INVENTION

The present invention relates to a glass-ceramic panel providing a cooking surface with at least one cooking zone, which is associated with a heating element with an annular or ring-shaped lighting device and which is marked off by an optical structured cooking zone indicating device visible on the cooking surface.

The present invention also relates to a method of making the glass-ceramic panel providing the cooking surface with the at least one cooking zone, which is associated with the heating element and provided with the structured cooking zone indicating device.

Glass-ceramic panels providing cooking surfaces with individual cooking zones are established parts of modern kitchen equipment. The cooking zones typically are part of the glass-ceramic panel. However they can also be formed by separate ceramic or metallic parts, which are inserted in openings in the glass-ceramic panel. The cooking zones on the cooking surface are marked off optically in order to make the manipulations of placing cooking or roasting vessels on the respective cooking zones easier and for optimum usage of heat energy.

A number of methods have been used in order to produce this sort of cooking zone marking off device, which is designated in the following as a cooking zone indicating device.

For example, it is possible to make it by providing a suitable pattern on the cooking surface that has a different appearance than the remaining surface of the glass-ceramic panel by means of a suitable treatment during the course of the manufacture of the glass-ceramic panel.

In order to guarantee a uniform appearance for the cooking surface portions that do not operate as cooking areas, numerous optical arrangements are known for producing the cooking zone indicating device under the glass-ceramic panel. They typically have lighting elements connected with light guides in different configurations, in order both to produce a through-going and also point-illuminating cooking zone indicating device, if necessary, in combination with a residual heat indicator.

These optical display elements are associated directly with the heating element arranged under the cooking zone, which typically is formed by a radiating heated body, but can also be embodied by an inductively acting heating element. For example, EP 0 540 876 A2 describes an externally lighted glass ring formed as a light conductor, which is integrated in an insulating ring of the heating element. This illuminated glass ring indicates the circular cooking zone inside of the ring and can be used also as a residual heat indicator.

An annular region marked off on the cooking surface acting as cooking zone indicating device is described in DE 40 04 309 A1. This cooking zone indicating device marks off this annular region in contrast to other parts of the cooking surface even more strongly by design elements.

DE 197 00 551 A1 discloses an annular state indicating device in the form of a lighted ring, which is arranged around a conventional heated cooking plate embedded in a glass-ceramic panel. An annular transparent region of the glass-ceramic panel is formed by a suitable annular interruption in a non-transparent cover layer on the underside of the glass-ceramic panel.

No structure is provided in the annular indicating regions in both these known cooking zone indicating devices.

A structured lighted cooking zone indicating device is described in EP 0 746 179 A2, which is equivalent to U.S. Pat. No. 5,750,959. In this cooking zone indicating device the previously described illuminated glass ring is covered by a light-blocking or light-impermeable heat-resistant foil provided with holes and arranged between the insulating wall for the heating element and the glass-ceramic underside, in order to provide a structured cooking zone indicating device. Since this foil is preferably mica and is only structured by a comparatively difficult cutting method, e.g. laser cutting methods, this method of providing a structured lighted cooking zone indicating device is comparatively expensive.

Further correct placement of this cooking zone indicating device during assembly in the cooking area is very troublesome, time-consuming and expensive.

Structured cooking zone indicating devices are currently in fashion in comparison to through-going cooking zone indicating devices and are frequently demanded by customers.

SUMMARY OF THE INVENTION

It is an object of the present invention to provide a glass-ceramic panel of the above-described type that provides a cooking surface with at least one cooking zone, which is associated with a heating element with an annular lighting device and which is marked off optically by a structured cooking zone indicating device on the cooking surface by means of the annular lighting device, by simple means, which is more economical and faster to make than the corresponding known mica mask and which guarantees easier handling during assembly.

It is also an object of the present invention to provide a method of making the above-described glass-ceramic panel providing a cooking surface with at least one cooking zone, which is associated with a heating element having an annular lighting device and which is marked off optically by a structured cooking zone indicating device by means of the lighting device, wherein this method is more economical and faster than the current method and which guarantees easier handling during assembly.

These objects, and others that will be made more apparent hereinafter, are attained in a glass-ceramic panel providing a cooking surface with at least one cooking zone, which is associated with a heating element having an annular lighting device and which is marked off optically by a structured cooking zone indicating device by means of the annular lighting device.

According to the invention a structured light-blocking or light-impenetrable covering layer is applied directly to the underside of the glass-ceramic panel and provided with transparent regions within the structured cooking zone indicating device corresponding to or according to a desired predetermined pattern or structure for the cooking zone indicating device.

The application of the coating layer with the structured light-permeable regions on the underside of the glass-ceramic panel can occur economically and faster than the production of a mica mask. Since the structure fixed to the underside of the glass-ceramic panel corresponds to the later position of the heating element in the cooking area, the assembly of the glass-ceramic panel requires no special handling in regard to the cooking zone indicating device. Since these known predetermined light-permeable regions are provided by application of the structure pattern, the light from the annular lighting device, preferably in the form of a lighted glass ring, passes through these holes or openings in the coating layer, thus forming the cooking zone indicating device.

The method of making the glass-ceramic panel providing the cooking surface with the at least one cooking zone, which is associated with the heating body and which has the structured cooking zone indicating device, includes the steps of:

printing the coating layer made from heat-resistant light-impermeable material provided with transparent regions corresponding to the desired or predetermined structure or pattern within the cooking zone indicating device directly on the underside of the glass-ceramic panel by means of screen printing; and drying the resulting printed glass-ceramic panel.

This screen printing technique guarantees an economical and fast application of the structured coating layer on the underside of the glass-ceramic panel with a minimum of time consumed.

Glass-ceramic cooking surfaces are known, which are light-impermeable in an unheated region from the underside. The inner regions of the cooking area are covered by illumination from the outside. For that purpose a smooth or flat organic light-impermeable enamel coating is applied to the underside of the glass-ceramic cooking surface in the appropriate regions by means of screen printing.

In the known embodiment the flat underside coating only serves for covering the unheated regions. There is no disclosure in the prior art that suggests the structured coating for designating the heated cooking zone and for conveying information regarding it to a user.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
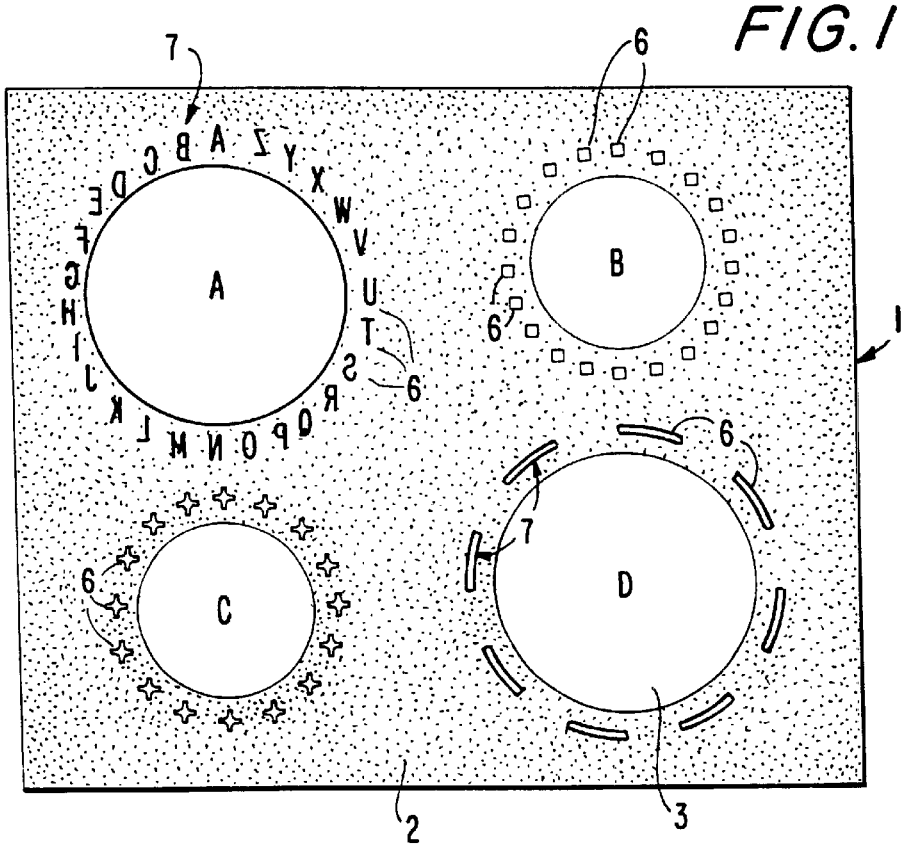
FIG. 1 is a diagrammatic plan view of a glass-ceramic panel with four cooking zones or areas A to D and including four different embodiments of the cooking zone indicating device according to the invention in the glass-ceramic panel underside.
Figure 2:
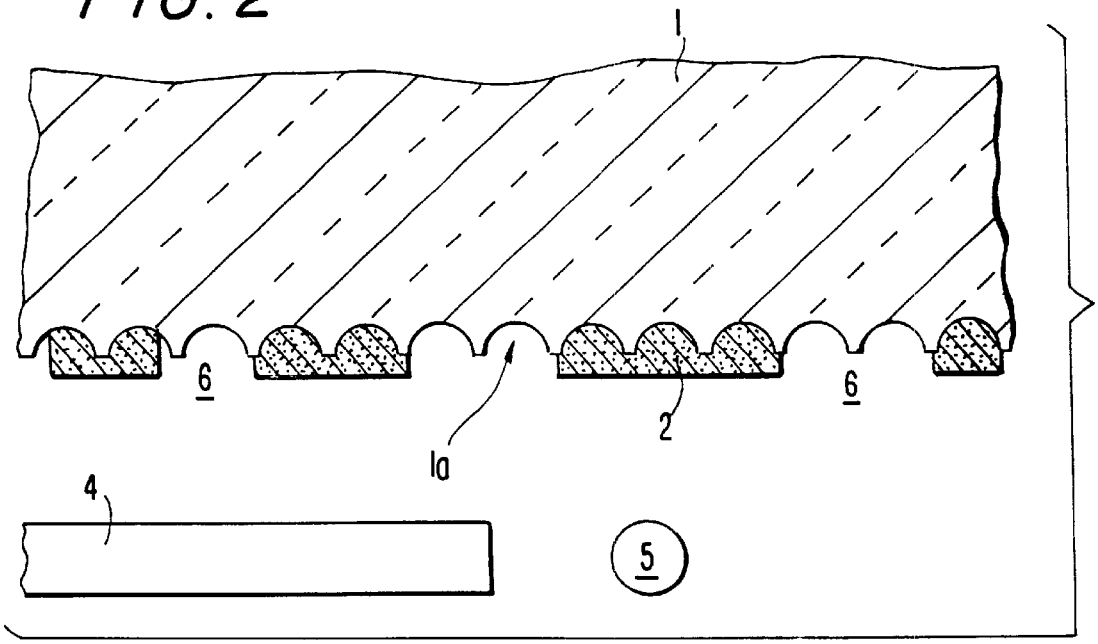
FIG. 2 is a diagrammatic cross-sectional view through the glass-ceramic panel of FIG. 1 with a symbolically indicated structured underside coating.

A glass-ceramic panel 1 acting as a cooking surface 3, whose cooking zones or areas A to D are associated with heating elements, typically radiating bodies 4 with an annular lighting device 5, preferably an externally lighted lighting ring, is illustrated diagrammatically in FIGS. 1 and 2. This type of structure is notoriously well known in the cooking equipment arts. These cooking zones or areas can, for example, by constructed according to the above-cited references, but they also may be constructed according to other methods within the scope of the present invention.

Different examples of patterns printed on the glass-ceramic panel 1 are shown in FIG. 1. Basically the region of the glass-ceramic panel 1 outside of the cooking zones A to D is covered with a patterned or structured light-impermeable or light-blocking coating layer 2 (black region) and has a light-permeable regions 6 corresponding to the predetermined or desired cooking zone indicating device 7. The cooking zone indicating device 7 in the cooking zone or area A comprises transparent portions or regions 6 provided in the coating layer 2, which form a series of mirror-image alphabetic characters (as seen from below). These mirror-image alphabetic characters are printable individually or together in series to form the cooking zone indicating device 7 and, if necessary, also the residual heat indicator.

The cooking zone indicating device 7 in the cooking zone or area B is a printed or impressed annular structure comprising a series of square or rectangular transparent regions 6 arranged in series in a circle. The cooking zone indicating device 7 in the cooking zone or area C is a printed or impressed annular structure comprising a series of transparent regions 6 in the form of plus signs. In contrast, the cooking zone indicating device 7 in the cooking zone or area D is a printed or impressed annular structure comprising a series of transparent regions 6 shaped in the form of respective circular arc sections spaced from each other around a circle.

The embodiment shown in FIG. 1 is only one example. The structure can understandably have other configurations, if its marking off function is guaranteed.

The essential features of the invention include a structured light-impermeable or blocking coating layer 2 on the underside of the glass-ceramic panel 1, which is provided with through-going openings or holes 6 forming a pattern. This pattern is particularly visible when light passes through these openings or holes 6 from below.

The application of the coating layer 2 is indicated symbolically in the cross-section in FIG. 2 through the glass-ceramic panel 1. The underside 1*a* of this glass-ceramic panel 1 has a knub-shaped structure because of manufacturing conditions. The structured light-impermeable coating 2 formed according to a predetermined pattern of the cooking zone indicating device 7 is applied to the underside of the glass-ceramic panel 1 by printing a light-impermeable varnish or lacquer on it, for example.

Because of the knub-like structure of the underside of the glass-ceramic panel 1 the thickness of the coating or layer 2 must be sufficient in order to make the entire surface under the coating layer sections or portions impermeable to light. This coating or layer thickness amounts a few $\mu$m to a few tenths of a mm, preferably however about 100 $\mu$m.

The long-time heat resistance of the varnish or lacquer must be reliable for all thermal loads. It must be guaranteed that the varnish or lacquer coating will not separate or peel off during heating. The symbols must always be observable without difficulty.

Alkyd resin varnish or lacquer with inorganic and organic ingredients, for example, is suitable for this kind of heat-resistance lacquer or varnish.

Also other coating materials with the same properties can be used.

The application of the coating layer 2 on the underside 1*a* of the glass-ceramic panel 1 advantageously is provided by a screen printing technique. After the application of the structured coating or layer the glass-ceramic panel is dried, preferably in a conventional drying oven.

As in the state of the art the cooking zone indicating device 7 can also be used as a residual heat indicator. In this embodiment the annular light element is activated by the residual heat contact of the power controller.

The disclosure in German Patent Application 199 06 737.6-34 of Feb. 18, 1999 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a glass-ceramic panel providing a cooking surface with at least one cooking zone having a cooking zone indicating device and a method of making the glass-ceramic panel with the cooking zone indicating device, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. A glass-ceramic panel providing a cooking surface with at least one cooking zone, which is associated with a heating body with an annular lighting device and which is optically marked off by a cooking zone indicating device on the cooking surface by means of the annular lighting device, wherein a structured light-impermeable coating layer (2) is provided on an underside of the glass-ceramic panel and includes a predetermined pattern of transparent regions (6), thus forming the cooking zone indicating device (7).

2. The glass-ceramic panel as defined in claim 1, wherein said structured coating layer (2) is provided on said underside by means of a screen printing method.

3. The glass-ceramic panel as defined in claim 1, wherein the structured coating layer (2) has a thickness from a few micrometers to a few tenths of a millimeter.

4. The glass-ceramic panel as defined in claim 3, wherein said thickness is about 100 micrometers.

5. The glass-ceramic panel as defined in claim 1, wherein said structured coating layer (2) is a lacquer or varnish layer.

6. The glass-ceramic panel as defined in claim 5, wherein the lacquer or varnish layer comprises an alkyd resin coating including organic ingredients.

7. A method of making a glass-ceramic panel providing a cooking surface with at least one cooking zone and a structured cooking zone indicating device, which is associated with a heating body, said method comprising the steps of:

a) printing a structured coating layer (2) made from heat-resistant light-impermeable material with transparent portions or regions (6) corresponding to a desired or predetermined pattern for the cooking zone indicating device directly on the underside of the glass-ceramic panel by means of a screen printing technique to form a printed glass-ceramic panel; and b) drying the printed glass-ceramic panel.

8. The method as defined in claim 7, wherein the structured coating layer comprises a lacquer or varnish.

9. The method as defined in claim 8, wherein the lacquer or varnish comprises an alkyd resin coating including organic ingredients.

10. A glass-ceramic panel providing a cooking surface with at least one cooking zone, which is associated with a heating body with an annular lighting device and which is optically marked off on the cooking surface by a cooking zone indicating device by means of the annular lighting device, said cooking zone indicating device consisting of a structured coating layer (2) printed on an underside of the glass-ceramic panel, and said structured coating layer (2) consisting of a plurality of transparent regions (6) and light-impermeable regions arranged in a predetermined pattern on the underside of the glass-ceramic panel.

11. The glass-ceramic panel as defined in claim 10, wherein said transparent regions (6) are through-going holes provided in said structured coating layer (2).

* * * * *